US010197235B2

(12) United States Patent
Bentley et al.

(10) Patent No.: US 10,197,235 B2
(45) Date of Patent: Feb. 5, 2019

(54) MULTIPLE LIGHT SOURCE ARTIFICIAL MOVING FLAME

(71) Applicant: Jenesis International Inc., Benton Harbor, MI (US)

(72) Inventors: Roger Donn Bentley, Coloma, MI (US); Kim Irwin McCavit, Saint Joseph, MI (US); Bradford Brian Jensen, Saint Joseph, MI (US)

(73) Assignee: Jenesis International Inc.MI (US)

( * ) Notice: Subject to any disclaimer, the term of this patent is extended or adjusted under 35 U.S.C. 154(b) by 201 days.

(21) Appl. No.: 15/268,774

(22) Filed: Sep. 19, 2016

(65) Prior Publication Data

US 2017/0082255 A1 Mar. 23, 2017

Related U.S. Application Data

(60) Provisional application No. 62/222,476, filed on Sep. 23, 2015.

(51) Int. Cl.

| | |
|---|---|
| ***F21V 7/00*** | (2006.01) |
| ***F21S 10/04*** | (2006.01) |
| *F21V 7/22* | (2018.01) |
| *F21Y 115/10* | (2016.01) |
| *F21W 121/00* | (2006.01) |

(52) U.S. Cl.

CPC ..... *F21S 10/043* (2013.01); *F21V 7/0066* (2013.01); *F21V 7/22* (2013.01); *F21W 2121/00* (2013.01); *F21Y 2115/10* (2016.08)

(58) Field of Classification Search

CPC ..... F21S 10/043; F21V 7/0066; F21V 7/22; F21E 2115/10; F21W 2121/00

USPC ..... 362/235

See application file for complete search history.

(56) References Cited

U.S. PATENT DOCUMENTS

| | | | | |
|---|---|---|---|---|
| 4,510,556 | A | 4/1985 | Johnson | |
| 4,551,794 | A | 11/1985 | Sandell | |
| 5,924,784 | A | 7/1999 | Chliwnyj et al. | |
| 6,616,308 | B2 | 9/2003 | Jensen et al. | |
| 6,926,423 | B2 | 8/2005 | Bucher et al. | |
| 7,837,355 | B2 | 11/2010 | Schnuckle | |
| 2001/0033488 | A1* | 10/2001 | Chliwnyj | F21S 10/04 362/231 |
| 2013/0070446 | A1* | 3/2013 | Chen | F21L 4/02 362/183 |
| 2014/0104820 | A1* | 4/2014 | Chiang | F21S 9/02 362/183 |

* cited by examiner

*Primary Examiner* — Anh T Mai
*Assistant Examiner* — Hana S Featherly
(74) *Attorney, Agent, or Firm* — George Pappas

(57) ABSTRACT

An artificial flame device that produces a visual effect similar to areal candle flame includes a flame structure made of partially opaque material. The flame structure defines an exterior surface and has a hollow region extending therein. An LED and an optical barrier are provided within the hollow region with the optical barrier located between the LED and a closed end of the flame structure. A second LED is preferably provided between the optical barrier and the flame structure closed end. The first LED is maintained at a constant intensity while the intensity of the second LED is varied between low and high intensities. Alternatively, the intensity of the second LED is inversely varied relative to said intensity of the first LED.

18 Claims, 13 Drawing Sheets

MULTIPLE LIGHT SOURCE ARTIFICIAL MOVING FLAME

CROSS REFERENCE TO RELATED APPLICATIONS

This application claims priority under 35 U.S.C. 119(e) of U.S. provisional patent application Ser. No. 62/222,476 filed on Sep. 23, 2015 entitled Multiple LED Moving Flame the disclosure of which is hereby incorporated herein by reference.

BACKGROUND OF THE INVENTION

1. Field of the Invention

The present invention relates generally to an artificial flame device that produces a visual effect similar to a real candle flame.

2. Background

Simulated battery powered flameless candles have been popular in recent years, and much work has been undertaken to advance the state of the technology.

Typical early simulated candles used simple electric screw-in lamps, which provided a static though bright simulation of a flame. A variety of lamps have been created which are designed to mimic the shape of a flame. Because there was no flicker, and also because of their typically large size, these were limited in their ability to create a realistic flame effect.

A major breakthrough in nameless candle technology came with U.S. Pat. No. 6,616,308, which eliminated the whole concept of an exposed simulated flame structure that is directly visible, which is hard to make look realistic. Instead in this approach the simulated wax candle is lit internally as if the flame had burned down within the candle wax. This approach has been very popular and is widely sold today.

However, there has always been a need for a more realistic visible simulated flame structure. Some candles, particularly narrow ones like tapers are not conducive to the hidden flame approach and through the years various approaches have been taken to attempt to create a more realistic flame structure.

U.S. Pat. No. 4,551,794 discloses an imitation flame that uses an incandescent light source, but improves the flame simulation, by positioning the flame on the top of a moving pendulum which is driven by an electromagnetic system that allows the flame to wiggle, or move from side to side. This gives the impression from certain viewing angles of a flame that is moved from side-to-side by a gentle breeze. This can provide a good side-to-side sense of motion but it does not provide any sense of vertical movement of the flame. While this approach was a major improvement over static flames, there are a number of disadvantages with this approach. From a manufacturing standpoint this approach is expensive to build because it requires many moving parts with moving electrical connection points through the pivoting axis to power the lit flame. These moving structures are also fragile and subject to damage in handling and shipment. Another challenge is the power consumption of the magnetic drive mechanism is significant, requiring additional power that would otherwise be available to light the flame, thereby reducing battery life and limiting application to those with steady AC power available through house wiring.

An improvement to the pendulum flame approach is found in U.S. Pat. No. 7,837,355. With this approach the cumbersome routing of power to the flame is eliminated by positioning a light source below the flame and projecting light onto a flat flame-shaped projection surface that is also moved by a pendulum driven by an electromagnet. In some cases as implemented by manufacturers, the flame projection surface has a loose fit on is axis of rotation thus allowing some modest rotation about a second axis. This allows not only forward and backward motion of the flame, but also some side-to-side motion which enhances the flame simulation over a somewhat wider viewing angle. Because the flame is lighter weight it has advantages in terms of the power consumption required by the electromagnetic drive system which can be much lighter duty than earlier incandescent products. However this approach still must allocate a significant amount of power to the electromagnetic drive mechanism reducing battery life and which also has significant cost involved in the electromagnetic drive coil. Because the flame-shaped surface onto which the LEDs project is relatively two dimensional, and because the candle is driven by directional LEDs typically on one side only, the candle flame is only effectively viewed over a field of view of less than 180 degrees. As in other approaches, this is successful in creating the effect of side-to-side flame movement, but not the more up-and-down movement seen in a flame that is affected by a gentle breeze.

Another way to create an improved flame effect without moving parts is found in U.S. Pat. No. 5,924,784 which describes a simulated flame that uses a plurality of small LEDs contained on a circuit board within a flame-shaped bulb. The LEDs can also be a variety of colors and the intent is to provide individual microprocessor control of these LEDs in a way that can simulate the flickering of a flame. This approach has a number of challenges, one is the high cost of the large number of LEDs required and also the development of a sequencing pattern of the LEDs that is effective in producing a realistic flicker. Another is the challenge of effectively diffusing the light sources so that they do not appear as separate point sources of light. Because of the relatively directional nature of the LEDs, it is hard to attain even illumination over a wide range of viewing angles of the flame with a diffusing structure, and this approach could work for a flame that might be viewed from front or back, but may be less effective when viewed from the side. As with other approaches, there is no mention of a method that will yield a flame simulation that has an effective up-and-down motion.

Similarly, U.S. Pat. No. 4,510,556 discloses a candle flame more simply composed of 3 light sources in a stacked arrangement within a flame structure. To simulate the turbulence of a flame they alter the duty cycle of the power to each light source, with the lowest source being the brightest with a relatively small flicker, with the middle source being less bright, and with a higher level of flicker, and then the uppermost LED being the most dim, at about half the brightness level of the lowest LED, and with a greater flicker. This creates a flame with decreasing brightness to the top, and with a stated clock frequency of 40 Hz, provides a relatively rapid pulse or flickering pattern that is at a level just perceptible to the eye. This effect could be accurately described as more of a shimmering effect as opposed to the more aggressive high frequency flickers found on products typically in the market today. However this will not produce any up-and-down sense movement of the flame, thus limiting its simulation effectiveness.

Another more recent variation in this approach is found in U.S. Pat. No. 6,926,423, which also seeks to simulate the appearance of a gas flame, such as what might be typically found in a gas lantern. Like the earlier patent they recognize the importance in a stacked arrangement of LEDs to have the lowest LED the brightest and the highest LED much dimmer, as might be found in a tapered flame. This also discloses a flicker or oscillation in the upper two LEDs that are independent of one another, but with a lower LED that does not flicker. This provides a continuous level of light from the bottom of the flame, with light above that providing variable oscillation or flicker, thus simulating a flame. White this produces a random flickering effect, it does not disclose how to create an effective up-and-down motion of the flame.

What is missing from all of these approaches is a simple, low-cost approach to simulate a flame which can create a clear sense of deliberate motion in an upward and downward direction, which can be viewed from any angle, and which can also achieve superior battery life performance.

SUMMARY OF THE INVENTION

The present invention overcomes many of the shortcomings of prior artificial flame devices and provides:

a. An artificial flame structure and illumination method that produces a visual effect that is similar to areal candle flame that is disturbed by air movement near the flame.

b. An artificial flame structure and illumination method that produces a visual effect that is similar to areal candle flame that is disturbed by air movement near the flame without the use of any moving parts.

c. An artificial flame structure and illumination method that produces a visual effect that is similar to a real candle flame that is disturbed by air movement near the flame and that maintains this visual effect when viewed from all sides of the artificial flame.

d. An artificial flame structure and illumination method that produces a visual effect that is perceived primarily as an up and down motion.

e. An artificial flame structure made from a partially opaque material, where the light intensity within the material is reduced noticeably as distance from a light source within the material is increased.

f. An artificial flame structure and illumination method that creates moving isophotes within a partially opaque material at frequencies that provide an illusion of motion within the flame structure.

g. A partially opaque artificial flame structure and illumination method that produces moving isophotes within the partially opaque material by varying the intensity of one or more light sources within the artificial flame structure.

h. A partially opaque artificial flame structure and illumination method that produces moving isophotes within the partially opaque artificial flame structure by coupling the light of one or more external light sources with varying intensities to the interior of the artificial flame structure.

i. An illumination method within a partially opaque material using two or more light sources that uses at least one of the light sources to obscure a portion of the moving isophotes created by a second light source.

j. An illumination method within a partially opaque material using two or more light sources that uses a barrier between the two light sources to restrict the influence of one of the light sources on the moving isophotes created by a second light source.

k. An illumination method where an optical barrier between the two light sources causes a reflection creating a third bright spot which prevents a darker portion from appearing in the space between the two light sources, which aids in creating a diffused even illumination through the relatively thin opaque material at the bottom portion of the flame, especially when both LEDs or light sources are fully illuminated.

l. An artificial flame structure and illumination method that produces a visual effect that is similar to a real candle flame that is disturbed by air movement near the flame; the flame structure including an external shell that resembles a real flame and an internal structure that positions two or more light sources at desired locations within the flame structure and may include an optical barrier between the two or more light sources.

In one form thereof the present invention is directed to an artificial flame device that produces a visual effect similar to a real candle flame. The device includes a flame structure made of a partially opaque material and defining an exterior surface. A hollow region within the flame structure is defined by an interior surface. The flame structure includes a closed end between the hollow region and the exterior surface. A light source within the hollow region is adapted to emit light. An optical barrier is provided within the hollow region between the light source and the flame structure closed end. The light emitted by the light source is varied between low and high intensities whereby visible moving isophotes are produced on the flame structure exterior surface.

Preferably the light source is an LED and the emitted light is varied between low and high intensities at a frequencies of less than 3.5 Hz and, most preferably, at frequencies between 1 Hz and 2 Hz. The optical barrier can be paint on a surface of the LED.

More preferably, a second light source is provided within the hollow region between the optical barrier and the flame structure closed end. The first and second light sources are preferably LED's and the optical barrier can be a reflector cup within the second LED or paint on a surface of the first or second LED.

The light emitted by the first LED is maintained at a constant intensity and light emitted by the second LED is varied between low and high intensities, preferably at a frequencies of less than 3.5 Hz or, more preferably, at frequencies between 1 Hz and 2 Hz. Alternatively, the intensity of light emitted by the second LED is inversely varied relative to the intensity of light emitted by the first LED, preferably between low and high intensities at a frequency of less than 3.5 Hz Preferably, the flame structure has a height defined by the distance between the second LED and the flame structure closed end which is greater than a minimum transverse distance from the second LED to the flame structure exterior surface.

BRIEF DESCRIPTION OF THE DRAWINGS

The above mentioned and other features and objects of this invention, and the manner of attaining them, will become more apparent and the invention itself will be better understood by reference to the following description of the embodiments of the invention taken in conjunction with the accompanying drawings, wherein:

FIG. 3*b* shows an isophote on the flame structure of FIG. 3*a* when only the lower light source is on.

Figure 1A:
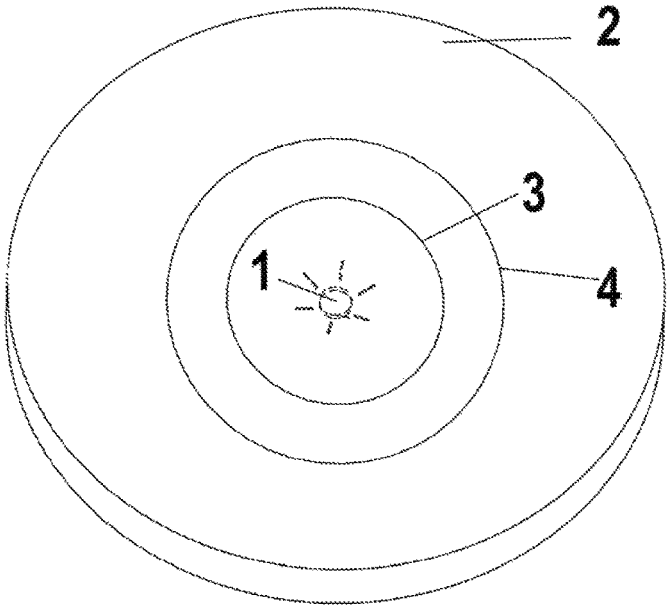
FIG. 1*a* shows a short cylinder made from a partially opaque, diffusing material with a light source at its center along with two isophotes created by the light source at a low brightness level.

Corresponding reference characters indicate corresponding parts throughout several views. Although the exemplification set out herein illustrates embodiments of the invention, in several forms, the embodiments disclosed below are not intended to be exhaustive or to be construed as limiting the scope of the invention to the precise forms disclosed.

DETAILED DESCRIPTION OF THE PREFERRED EMBODIMENTS

FIG. 1*a* is a two dimensional representation of a cylinder (2) made from a partially opaque, light diffusing material with a light source (1) at the center of the cylinder (2). For simplicity, the light source (1) is shown even though it is below the surface of the cylinder (2), but it is understood that only the surface of the cylinder (2) would actually be directly viewable from outside the cylinder (2). For purposes of this discussion, it is assumed that the thickness of the cylinder is relatively thin compared to the diameter of the cylinder and therefore the distance from the light source (1) to the inner circle (3) drawn on the end surface of the cylinder is substantially less than the distance from the light source (1) to the outer circle (4) drawn on the end surface of the cylinder.

The cylinder (2) is made from a slightly opaque, light diffusing material, with optical properties chosen so that light intensity on the surface of the cylinder (2) is noticeably reduced as distance from the light source (1) increases. In FIG. 1*a*, all points on the inner circle (3) are equally distant from the light source (1), and so will be illuminated at the same intensity and therefore the inner circle (3) defines an isophote for that particular intensity, henceforth referred to as isophote (3). Outer circle (4) defines a second isophote (4) which will be at a lower intensity due to its greater distance from the light source (1).

Figure 1B:
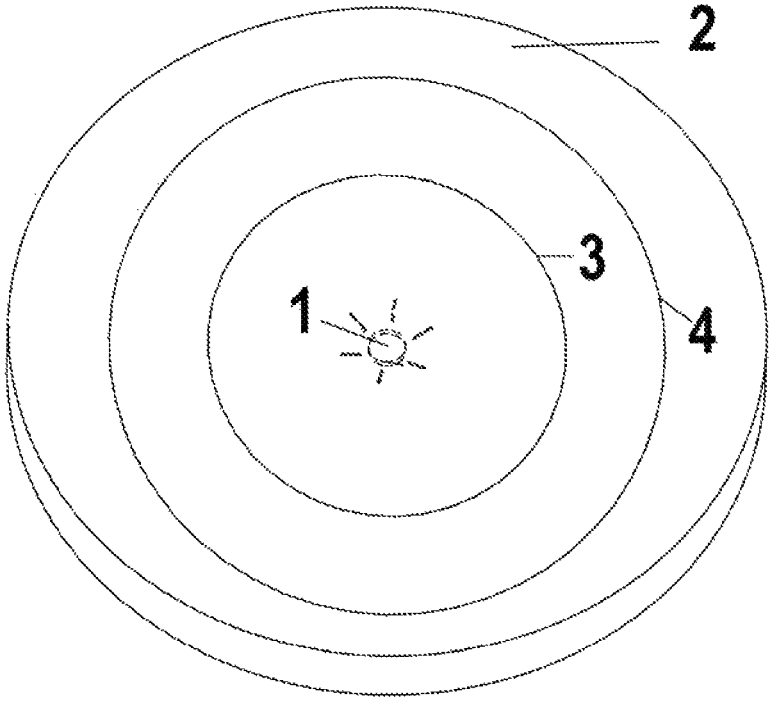
FIG. 1*b* shows a short cylinder made from a partially opaque, diffusing material with a light source at its center along with two isophotes created by the light source at a higher brightness level.
Figure 1C:
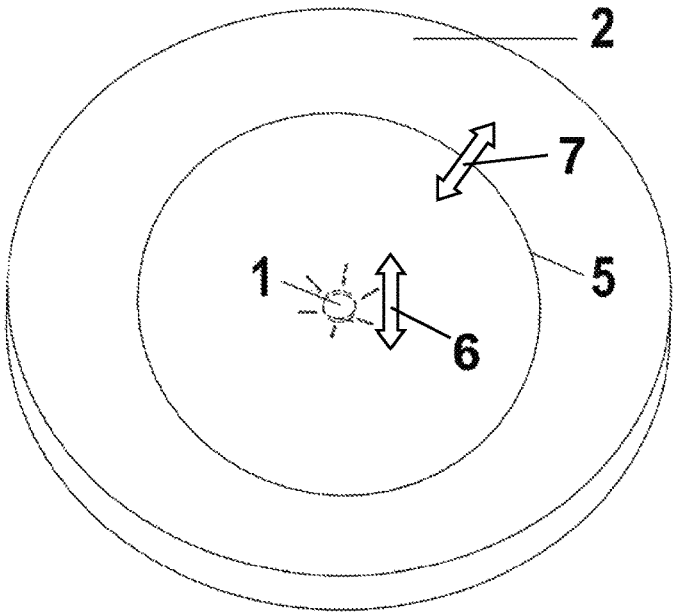
FIG. 1*c* shows a short cylinder made from a partially opaque, diffusing material with a light source at its center along with a moving isophote produced by variations in brightness of the internal light source.

FIG. 1*b* shows the same cylinder and isophotes when the brightness of the light source (1) has been increased. For these discussions, isophotes with the same numerical identifier are at the same intensity. Since the brightness of the light source in FIG. 1*b* is greater than the brightness of the light source in FIG. 1*a*, isophote (3) is further from the light source (1) than it is in FIG. 1*a*. Similarly, isophote (4) in FIG. 1*b* is further from the brighter light source (1) in FIG. 1*b* as compared to isophote (4) in FIG. 1*a*. In general the locations of isophote (3) and isophote (4) relative to the center of the end face of the cylinder (2) can be varied by changing the brightness of the light source. If the brightness of the light source (1) is varied slowly and smoothly enough, the human eye will be able to follow the position of isophotes on the surface of the cylinder. These isophotes will be perceived to move inwards when the brightness of the light source is decreasing or outwards when the brightness of the light source is increasing as illustrated in FIG. 1*c* where the bidirectional arrow (6) near light source (1) indicates the brightness of the light source is varying up and down and the bidirectional arrow (7) near isophote indicates that isophote 5 is moving in and out in response. For the human eye to perceive the motion of the isophotes they need to move smoothly and slowly. It is well known by those skilled in the art that the human eye cannot detect changes in intensity in a light source if the frequency of the intensity changes is above 60 Hz. At slightly lower frequencies, starting at approximately 40 Hz and extending down to approximately 5 Hz, the eye can not follow the motion of the isophotes, but the changing intensity is noticeable and the illuminated surface appears to blink on and off or flicker. Frequencies in this range are used in many prior art electronic candles to produce a flickering effect. At frequencies below 5 Hz, starting at approximately 3 Hz, the eye can begin to follow the motion of the isophotes. At frequencies of below 3 Hz, the moving isophotes become more and more discernable.

Figure 2A:
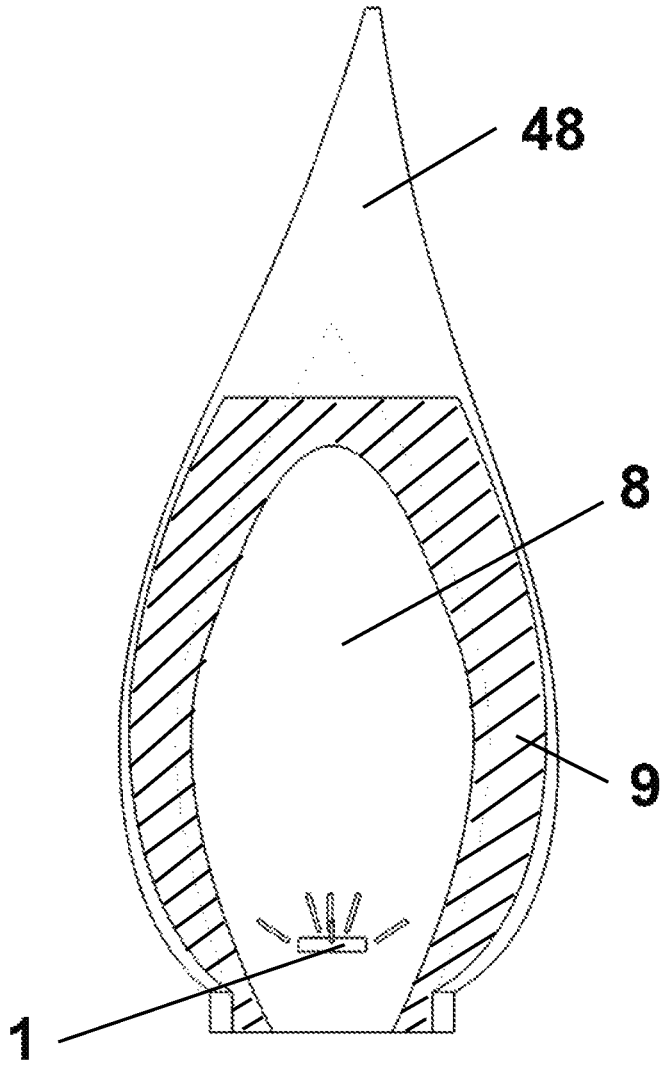
FIG. 2*a* shows a prior art artificial flame structure with a cut away view revealing an internal light source and a hollow chamber.

FIG. 2*a* shows a flame structure (48) that is made from a partially opaque, diffusing material. A cut away (9) reveals an internal light source (1) and a hollow region (8) within the flame structure (48). It will be understood by those skilled in the art that the actual light source could be external to the flame structure (48) with a means such as a light pipe used to direct the light from the external light source to the location indicated by internal light source (1). Within the hollow region (8), the reduction in intensity of the light from an omnidirectional light source (1) would be inversely proportional to the square of the distance from the light source (1). However, partial internal reflections from the inner surfaces of the hollow region (8) will increase the light intensity within the hollow region (8) in a manner that partially offsets the expected inverse square law reduction in intensity. In addition, the light source (1) would typically be a directional light source, such as a light emitting diode, aimed upwards along the major axis of the flame structure. The directional properties of the light source (1) can be used to even out the light intensity within the hollow region (8), but to simplify is discussion it will be assumed the light source (1) is omnidirectional.

Figure 2B:
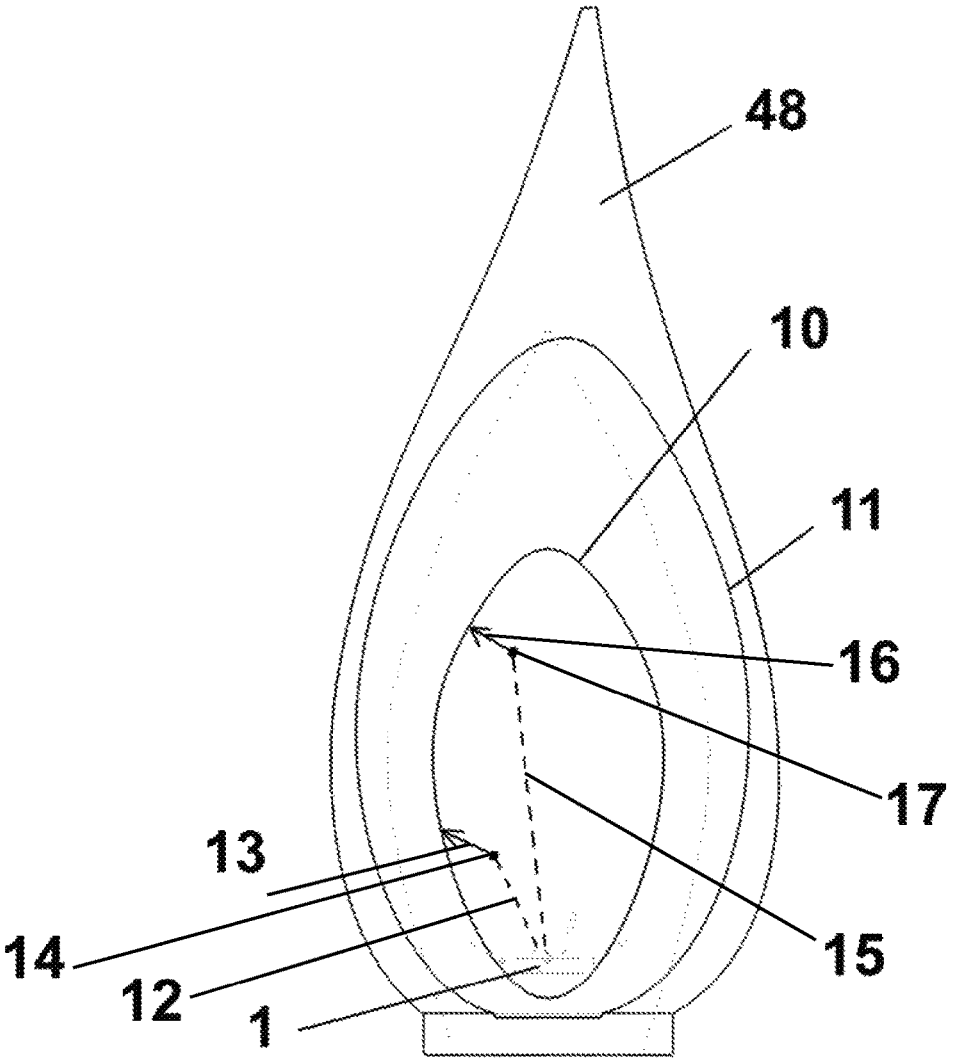
FIG. 2*b* shows a prior art artificial flame structure of FIG. 2*a* with two isophotes created by the internal light source.

The properties of the material used to make the flame structure are chosen to reduce light intensity at a significantly higher rate than along the length of the hollow region (8). Referring now to FIG. 2*b*, isophote (10) and isophote (11) are shown where isophote (11) is less intense than isophote (10) since light must travel a greater distance through the partially opaque material to reach isophote (11). The isophotes are elongated because the intensity on the surface of the flame structure (48) is primarily determined by the amount of semi opaque diffusing material that the light from the light source (1) must travel through before reaching the surface of the flame structure (48). In FIG. 2*b*, two light rays are traced from the internal light source (not shown) and the surface of the flame structure (48). Dotted lines are used to indicate where the light ray is traveling through the hollow regions (8). Solid lines are used to indicate where the light rays are traveling through the semi opaque, diffusing material. The light ray identified by (12), (13), first travels through the hollow region (8) with very little reduction in intensity until it strikes the inner wall of the hollow region (8) at point (14) and then continues along path (13) where there is significant attenuation in intensity. The light ray identified by (15), (16), travels much further in the hollow region (8) before it enters the diffusing material at point (17) so the length of the path (16) to isophote (10) is shorter than path (13). However, since the drop in intensity with distance is much greater in the flame material than in the hollow region, the reduction in intensity in the flame material will dominate and path (16) and path (13) may be of similar lengths. In this way the isophotes become elongated along the major axis of the flame structure (48). In addition, variations in the external shape of the flame structure (48) can be used to reduce or increase the amount of material the light ray must travel through before it reaches the surface of the flame structure (48) providing a secondary way to modify the shape of the resulting isophotes. Further, if the light source (1) is directional and/or there are diffusing or reflecting barriers within the flame structure (48), there will be additional modifications to the shapes of the isophotes on the surface of the fame structure (48). Also, the hollow region (8) can be extended or shortened to further modify the shapes of the isophotes on the surface of the flame structure (48).

Figure 2C:
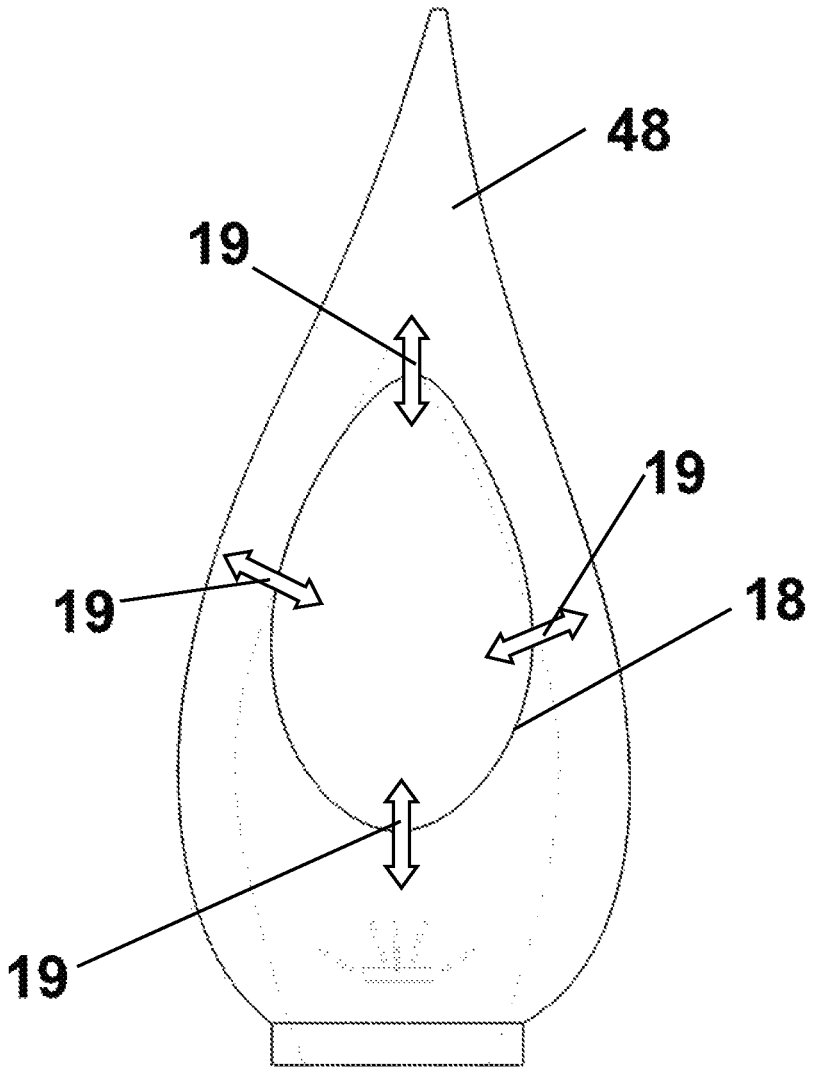
FIG. 2*c* shows a prior art artificial flame structure of FIG. 2*a* with a moving is created by varying the brightness of the internal light source.

FIG. 2*c* shows an isophote (18) on the surface of the flame structure (48). Bi-directional arrows (19) on the isophote (19) indicate how the isophote would appear to move as the brightness of the internal light source (48) is varied with lower brightness levels causing the isophote to contract and higher brightness levels causing the isophote to expand. If the brightness levels of the internal source (48) are varied slowly and smoothly enough, the change in positions of the isophote (18) will be perceived as motion. The result will be that the flame structure appears to shrink and expand, or pulse, which is an unnatural appearance for a candle flame since the lower portion of a real candle flame does not get dimmer when the flame is disturbed by air movement near the flame. Since this appearance is unnatural, it is generally avoided in prior art artificial flames. In prior art imitation flames with this type of construction, if the brightness of the internal light source is varied, it is varied at a frequency high enough that the eye does not readily perceive that the lower portion of the flame structure (48) is getting significantly dimmer. While this result in a pleasing, flickering or shimmering affect, it does not create an illusion that the artificial flame is moving up and down as would a real candle flame when it is disturbed by air movement near the flame.

Figure 3A:
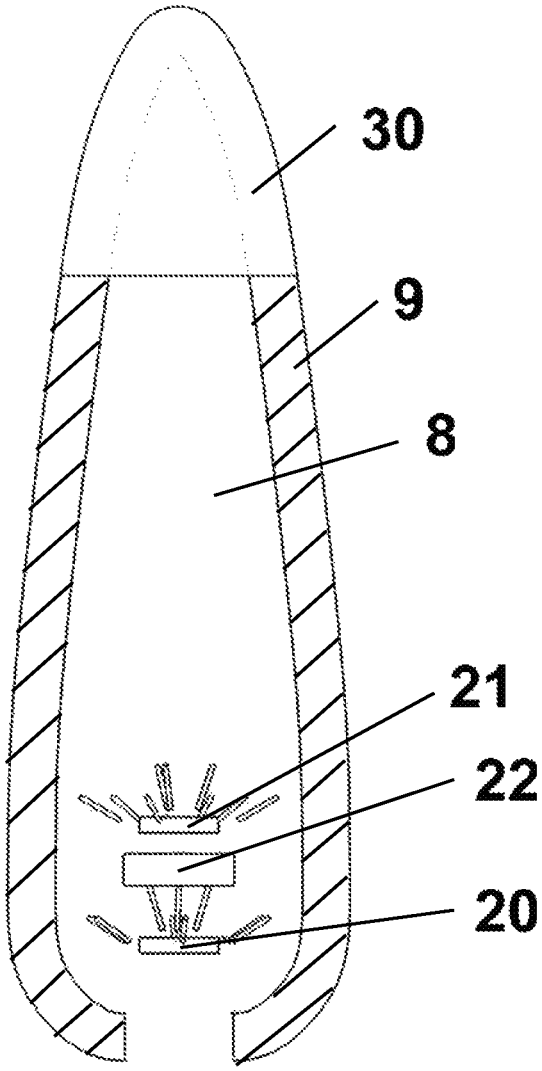
FIG. 3*a* shows the artificial flame structure of the current invention with a cut away view revealing two internal light sources, a hollow chamber and an optical barrier.

FIG. 3*a* shows a flame structure (30) that is made from a partially opaque, diffusing material. A cut away (9) reveals an internal, upper light source (1) and a hollow region (8) within the flame structure (30). The properties of the material used to make the flame structure (30) are chosen to reduce light intensity within the material at a significantly higher rate than in the hollow region (8). The flame structure (30) is designed so that the distance from the upper light source (21) to the tip of the flame structure (30) is greater than the distance from the upper light source (21) and the sides of the flame structure (30).

A lower light source (20) is shown that is positioned generally below the upper light source (21). It will be understood by those skilled in the art that the actual light source for either or both of the internal light sources could be external to the flame structure (30) with means such as a light pipes used to direct the light fro the external light sources to the location indicated by upper light source (21) and lower light source (20). Also shown is an internal optical barrier (22) that reduces or prevents light from the lower light source (20) from reaching the upper portion of the flame structure (30) above the optical barrier (22) and vice versa. The surface of flame structure (30) will be brightest where the surface of the flame structure is closest to light sources (20) and (21), no each light source (20) and (21) will create a bright spot on the surface nearest it. Since areal candle flame does not have two distinct bright spots, the two light sources (20) and (21) should be placed close together so that the diffusing properties of the flame structure (30) will cause the two bright spots to overlap so that they blend together and become less distinct. The optical barrier (22) can also provide some reflection from both the lower LED (20), and also from the upper LED (21). This reflection creates the appearance of a pseudo third point source of light, which helps prevent a darker zone from appearing between the LEDs (20/21). Because a typical flame is slender, the partially opaque diffusing material is necessarily thin near the light sources which can make it more difficult for the diffusing material to overlap and blend the light from the two sources. By adding the pseudo third point source of light between the upper and lower light sources, the distance between light source is lessened. This helps to create a more even illumination of the lower portion of the flame by obscuring the visibility of two separate point sources of light to an external viewer. This is especially helpful when the lower source (20) is a directional LED.

Figure 3B:
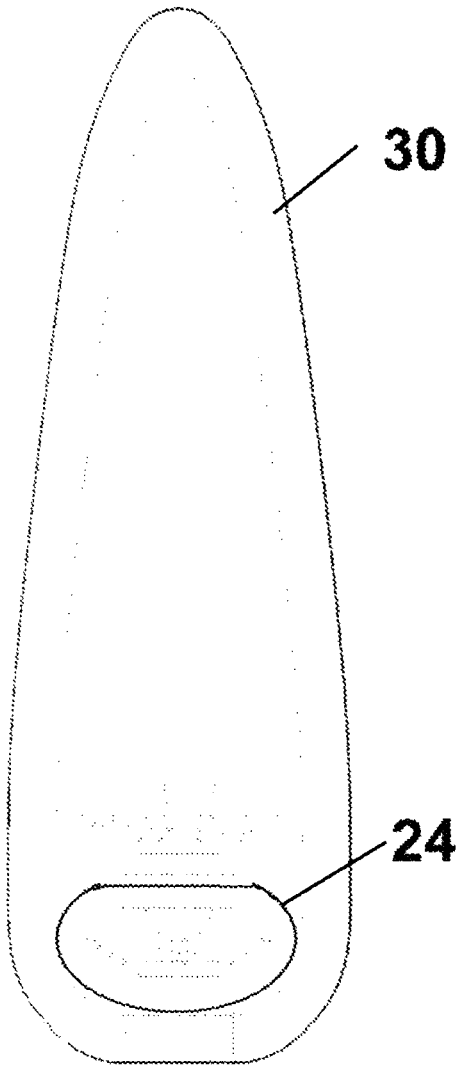

FIG. 3*b* shows an isophote (24) created by lower light source (20) when upper light source (21) is off. The optical barrier (22) prevents a portion of the light from light source (20) from reaching above the optical barrier (22) which concentrates the resulting isophotes in the lower portion of the flame structure (30). Similarly, isophotes created by upper light source (2)) will be concentrated in the upper portion of flame structure (30). The size, position, and opacity of the optical barrier (22) can be selected to allow isophotes created by the individual light sources (20 and (21) to overlap on the flame structure (30).

Figure 3C:
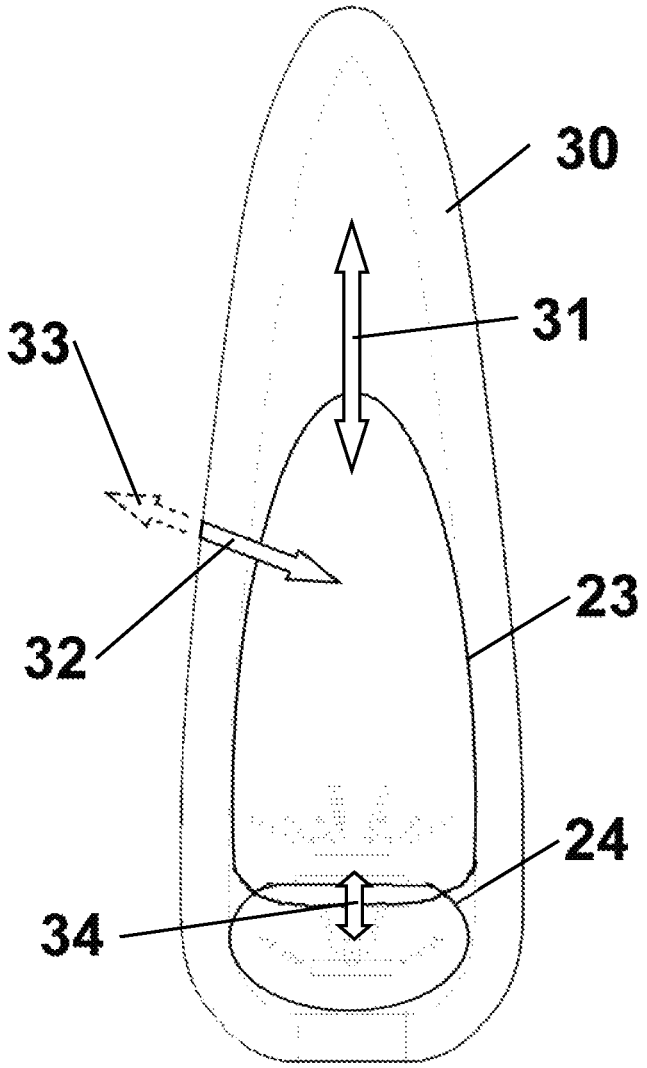
FIG. 3*c* shows isophotes produced by both a lower and upper LED

FIG. 3*c* shows two isophotes resulting from the construction shown in FIG. 3*a* when the optical barrier (22) is designed to allow the individual isophotes from light sources (20) and (21) to overlap. Isophote (23) is created by upper light source (21) when lower light source (20) is off. Similarly, isophote (24) is created by the lower light source when upper light source (21) is off. When both light sources are on, isophotes (23) and (24) would be replaced by a new isophote (not shown) that would generally be the superposition of isophotes (23) and (24). To simplify this discussion, only the isophotes created by one of the light sources when the other is off will be shown, but it should be understood that both light sources would typically be on at the same time and the resulting isophote would be a combination of the two.

In FIG. 3*c* it is assumed that the brightness of upper light source (21) is slowly and smoothly varying so that isophote (23) would be perceived to expand and contract as discussed before. If the brightness of lower light source (20) is held at a relatively constant brightness, the isophote (24) it creates will not have any apparent motion. The isophote that results from the superstition of isophotes (23) and (24) will pulse in and out above the upper light source (21) as indicated by the bidirectional arrows (31), (33) and (32). However, whenever the lower light source (20) is significantly brighter than the upper light source (21), a moving isophote in the lower part of the flame structure (30) created by the upper light source (21) will be obscured by brighter isophotes created by lower light source (20) as indicated by the shorter length of bidirectional (34). Therefore, in the lower portion of flame structure (30), the superposition of isophotes from the upper and lower light sources (21) and (20) will be dominated by the lower light source (20) and it their positions will vary only slightly with variations in brightness of the upper light source (21). Optionally, the intensity of the lower light source (20) can be varied in an inversely proportional manor with respect to the variations in brightness of the upper light source (21) to further reduce any apparent motion of the superimposed isophotes in the lower portion of the flame structure (30). Additional small variations in the brightness of lower light source (20) may be added, if desirable, as long as the brightness of lower light source (0) remains high enough to obscure the moving isophotes of upper light source (21) in the lower portion of flame structure (30).

Examining now the case where isophote (23) is expanding due to increasing brightness of upper light source (21), it can be seen that isophote (23) can move upward substantially without reaching beyond the surface of the flame structure (30) as indicated by the bidirectional line (31). However, isophote (23) can only move a limited distance to the side before it reaches the surface of flame structure (30) as indicated by line (32). Dotted line (33) indicates where the isophote would have been if the flame structure were wider, but since the isophote cannot move beyond the edge of the flame structure (30), it will appear to stop when it reaches this edge. For this reason, the apparent motion of the isophote is dominated by the up and down motion indicated by bidirectional line (31). For the same reason, as the brightness of the upper light source (21) is reduced, there will be more apparent contraction along bidirectional line (31) than along the line (32). To best insure the motion of the upper isophotes is perceived as up and down motion, the height of the flame structure (30) above the upper light source (21) must be greater than the minimum distance from the upper light source (21) to the side of the Flame structure (30). Ideally this ratio should be greater than 2:1 to enhance the perception the isophotes are moving up and down.

The superimposed isophotes in the upper portion of the flame structure (30) are primarily determined by the brightness of upper light source (21), but the superimposed isophotes in the lower portion of the flame structure (30) are dominated by the relatively constant lower light source (20) and so will re relatively constant. Since only the upper portions of the superimposed isophotes are contracting and expanding, the apparent effect is that the isophote originates in the lower portion of flame structure (30) and is getting shorter and taller. In addition to obscuring the apparent motion of isophotes in the lower portion of the flame structure (30), thus creating the appearance that the isophotes on the surface of the flame structure (30) are getting shorter and taller, the lower light source (20) also keeps the lower portion of the flame structure illuminated at a relatively constant intensity as occurs in a natural candle flame. This combination provides a very realistic simulation of a candle flame that is disturbed by air movement near the flame.

Figure 4:
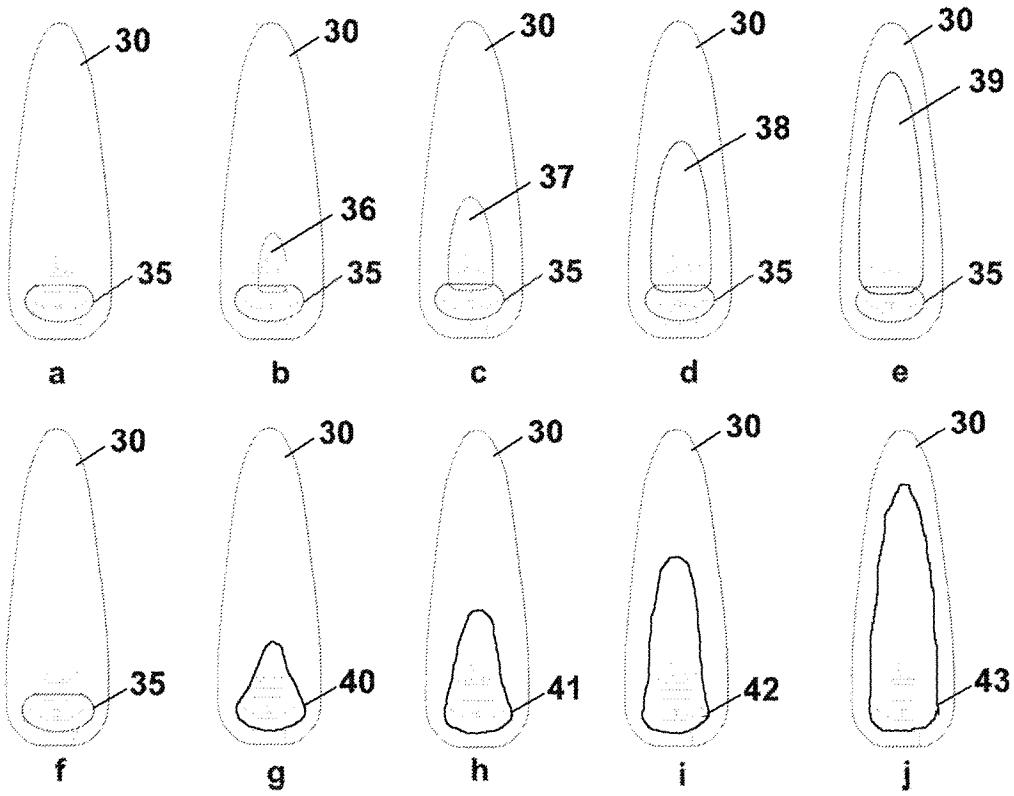
FIG. 4 shows the effect of moving isophotes as current is varied in the upper LED

FIG. 4 illustrates several of the isophote patterns that can be created by the invention. The top row in FIG. 4 shows the individual isophotes created by lower light source (20) and upper light source (21). The bottom row shows the isophotes as they actually appear on the surface of the flame structure (30). In FIG. 4*a*, only the lower light source (20) is on and therefore only lower light source (20) can create isophotes, one of which is shown (35). In FIG. 4*b* through FIG. 4*e*, it is assumed that lower light source (20) is at the same brightness and creates the same isophote (35) in each figure. In FIG. 4*b*, upper light source (21) is on, but at a low level so that an isotope (36) that it creates at the same intensity as isophote (35) is relatively small. Similarly, in FIGS. 4*c* through 4*e*, the isophotes (37), (38) and (39) are the result of increasing the brightness level of upper light source (21).

FIG. 4*f* through 4*j* show the resulting isophotes at the same intensity as isophote (35) in FIG. 4*a*. The isophotes shown in the upper row of FIG. 4 combine to form an isophote whose shape is primarily determined by upper light source (21) on the upper surfaces of flame structure (30) and by lower light source (20) on the lower surfaces of flame structure (30). In FIG. 4*f*, the upper light source (21) is not on and isophote (35) is the same as in FIG. 4*a*. In FIG. 4*g*, the combined isophote (40) appears a little taller as upper light source (21) begins to contribute to the surface intensity on flame structure (30). Similarly, in FIGS. 4*h* through 4*j*, the resulting combined isophotes (41), (42), and (43) appear progressively taller as the brightness of upper light source (21) is increased.

Figure 5:
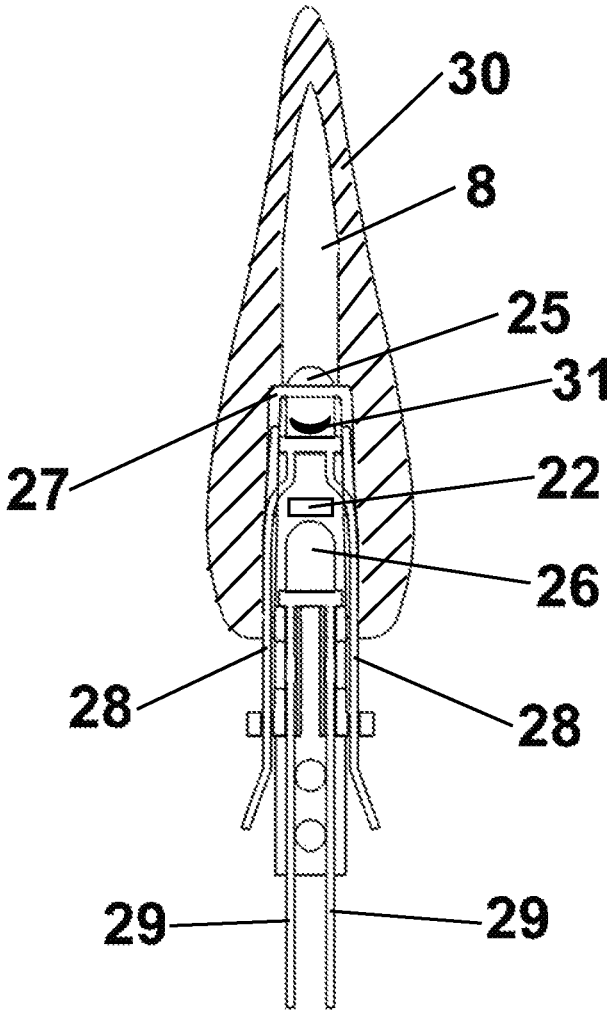
FIG. 5 shows a preferred embodiment of the current invention.

FIG. 5 shows a cross section of a preferred embodiment of the current invention. A flame structure (30) is constructed of a partially opaque, diffusing material. A hollow region (8) receives a transparent cylindrical structure (27) that holds two light sources (25) and (26) and provides a low attenuation path for light from the upper light source (25) to move upward in the flame structure (30). Light sources (25) and (26) re preferably 3 mm light emitting diodes (LEDs) with a warm white characteristic color resembling the color of a real candle flame. Cylindrical structure (27) can also retain an optical barrier (22) that limits the regions within the flame structure (30) where light from the lower light source (26) can obscure isophotes created by the upper light source (25). As those skilled in the art will realize, the internal construction of LED (25) would typically include a reflector cup (31) for directing the light produced by LED (25) upwards. The reflector cup (31) will also prevent some of the light from LED (26) from reaching above LED (25) and can therefore serve the same purpose as optical barrier (22), potentially eliminating the need for a separate optical barrier (22). Those skilled in the art will also realize that optical barrier (22) need not be a separate piece but could be a thin coat of optically opaque material placed on the bottom surface of LED (25) or on the top surface of LED (26), such as a paint. The leads (28) of upper LED (25) are formed near the bottom of LED (25) so that they can pass around lower LED (26), allowing LEDs (25) and (26) be placed in close proximity to each other.

Figure 6:
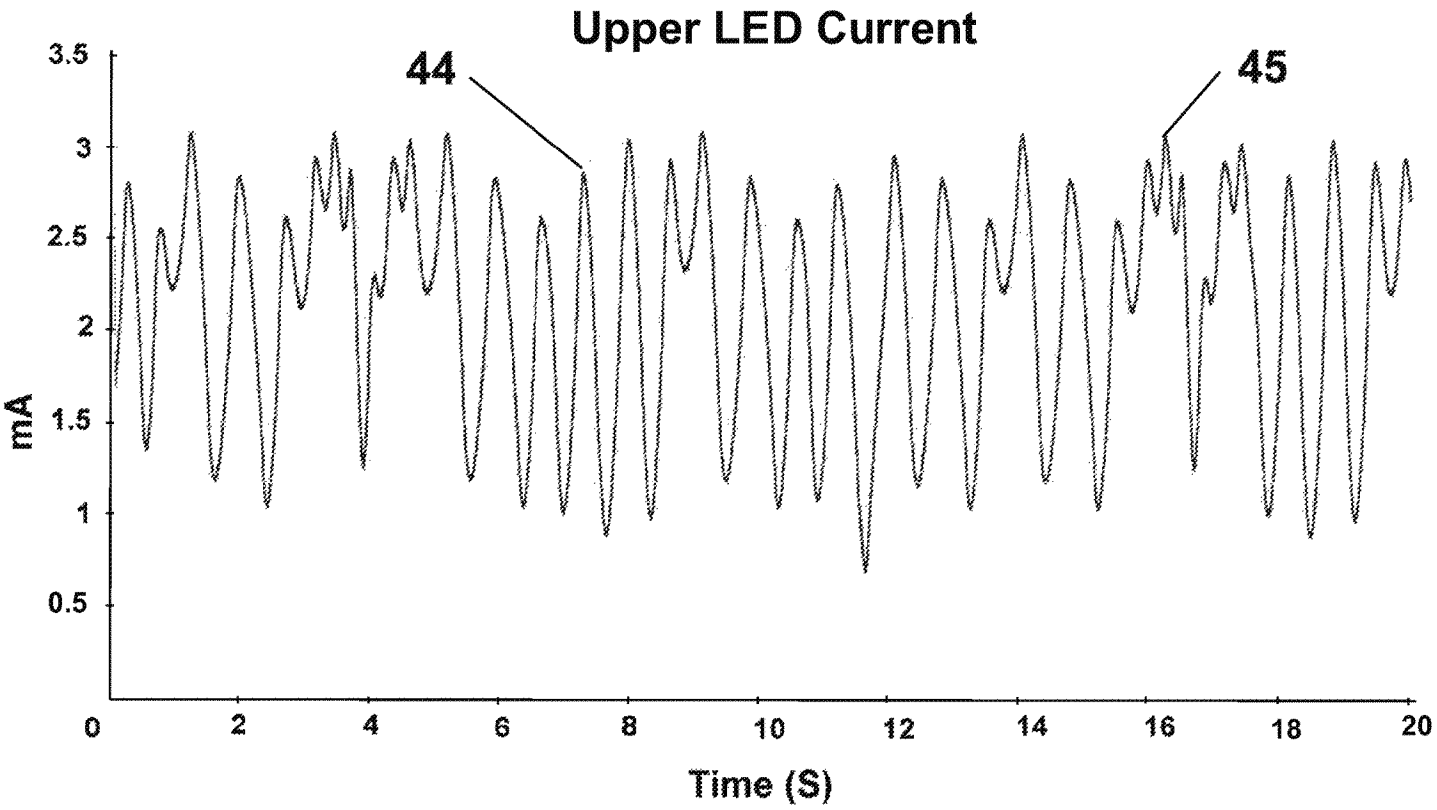
FIG. 6 shows a preferred current waveform used in the current invention.

A constant current of 12 mA is applied to LED (26) through leads (29) to provide enough brightness to obscure isophotes created by upper LED (25) in the lower portion of the flame structure (30). A varying current between 0 mA and 3.5 mA is applied to LED (25) through leads (28) at a low enough frequency to create moving isophotes on the surface of the flame structure (30) above LED (25). The varying current applied to upper LED (25) varies at a speed and manner to produce the moving isophotes on the surface of flame structure (30) that are perceived as moving up and down while the base of the flame structure remains at a relatively constant intensity. Since a real candle flame disturbed occasionally by air movement near the flame moves up and down in a non-repetitive pattern, the varying current used to drive the upper LED (25) should simulate a similar pattern. The current pattern shown in FIG. 6 is one such pattern that will provide isophotes that move up and down on the surface of the flame structure (30) in a pattern that does not repeat often enough to be noticeable, but those skilled in the art will realize that there are a multitude of patterns that would provide similar results. The predominate frequencies (44) in FIG. 6 are in the 1 Hz to 2 Hz range which result in isophotes that are moving slowly enough to be perceived as moving. There are also some slightly higher frequencies (45) in the 3.5 Hz range, but they are much smaller than the dominate frequencies and do not detract from the apparent motion of the flame while adding a pleasing effect.

Figure 7:
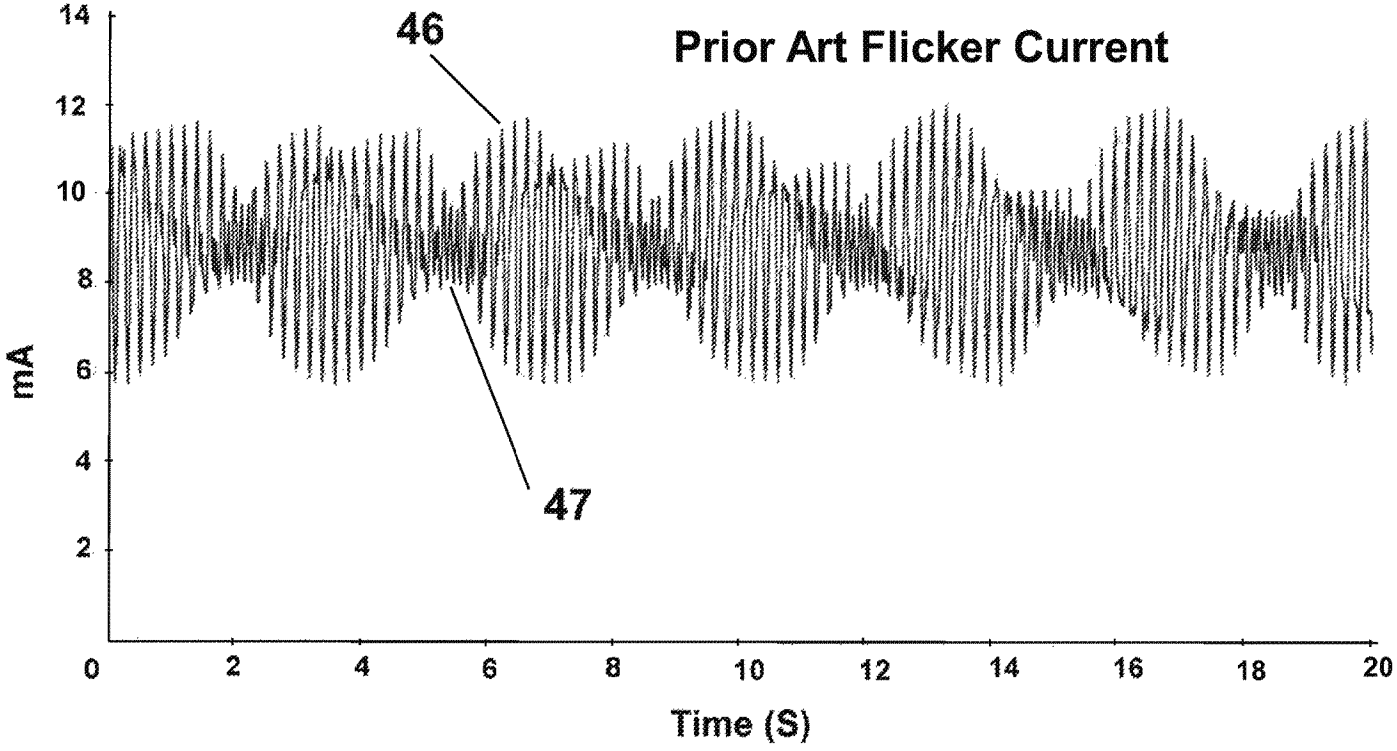
FIG. 7 shows a typical prior art flickering style waveform.

By way of contrast, FIG. 7 shows the current pattern in a typical prior art candle. The predominate frequencies (46) are in the 4 Hz to 5 Hz range which results in a pleasant flickering effect, but is too fast produce isophotes that are moving slowly enough to be readily perceived as moving. There are also higher frequencies (47) in the 9 Hz to 10 Hz range which, while pleasing, are not useful for creating the impression of up and down movement of the present invention.

While the described invention provides a realistic impression of a candle flame moving up and down when it is disturbed by air movement near the flame, higher frequency signals could also be added along with the slower signals that create the illusion of motion. These higher frequency signals could add a flickering or shimmering effect to the overall up and down motion of the current invention.

While this invention has been described as having an exemplary design, the present invention may be further modified within the spirit and scope of this disclosure. This application is therefore intended to cover any variations, uses, or adaptations of the invention using its general principles.

What is claimed is:

1. An artificial flame device that produces a visual effect similar to a real candle flame moving up and down when disturbed by a slight breeze, said device comprising:

a flame structure made of a partially opaque material and defining an exterior surface;

a hollow region within said flame structure defined by an interior surface;

said flame structure including a closed end between said hollow region and said exterior surface;

a light source within said hollow region adapted to emit light;

wherein said light emitted by said light source is varied between low and high intensities whereby isophotes produced on said flame structure exterior surface move along the surface of said flame structure at a speed that is slow enough and smooth enough to be perceived as motion by a human eye; and, an optical barrier within said hollow region between said light source and said flame structure closed end that reduces said light intensity variations below said optical barrier.

2. The artificial flame device of claim 1 wherein said light emitted by said light source is varied between low and high intensities at a frequencies of less than 3.5 Hz.

3. The artificial flame device of claim 1 wherein said optical barrier includes a reflective surface.

4. The artificial flame device of claim 1 wherein said light source is an LED.

5. The artificial flame device of claim 4 wherein said optical barrier comprises paint on a surface of said LED.

6. The artificial flame device of claim 1 wherein said flame structure comprises a height between said light source and said flame structure closed end which is greater than a minimum transverse distance from said light source to said flame structure exterior surface.

7. An artificial flame device that produces a visual effect similar to a real candle flame moving up and down when disturbed by a slight breeze, said device comprising:

a flame structure made of a partially opaque material and defining an exterior surface;

a hollow region within said flame structure defined by an interior surface;

said flame structure including a closed end between said hollow region and said exterior surface;

a first light source within said hollow region adapted to emit light;

wherein said light emitted by said first light source is varied between low and high intensities;

wherein isophotes produced on said flame structure exterior surface by said first light source move along the surface of said flame structure at a speed that is slow enough and smooth enough to be perceived as motion by a human eye, and, a second light source within said hollow region and below said first light source adapted to obscure said isophotes from said first light source below said first light source.

8. The artificial flame device of claim 7 wherein said first and second light sources are LED's.

9. The artificial flame device of claim 7 wherein an optical barrier is positioned within said hollow region between said first light source and said second light source that reduces said light intensity variations from said first light source below said optical barrier.

10. The artificial flame device of claim 9 wherein said first light source is an LED and said optical barrier is a reflector cup within said first LED.

11. The artificial flame device of claim 9 wherein said first and second light sources are LED's and said optical barrier comprises paint on a surface of said first LED.

12. The artificial flame device of claim 9 wherein said first and second light sources are LED's and said optical barrier comprises paint on a surface of said second LED.

13. The artificial flame device of claim 9 wherein said optical barrier includes a reflective surface.

14. The artificial flame device of claim 7 wherein said light emitted by said second light source is maintained at a constant intensity and light emitted by said first light source is varied between low and high intensities at a frequencies of less than 3.5 Hz.

15. The artificial flame device of claim 7 wherein said light emitted by one of said first or second light sources is varied between low and high intensities at a frequencies of less than 3.5 Hz.

16. The artificial flame device of claim 7 wherein said intensity of light emitted by said first light source is inversely varied relative to said intensity of light emitted by said second light source.

17. The artificial flame device of claim 16 wherein light emitted by said first and second light sources is varied between low and high intensities at a frequencies of less than 3.5 Hz.

18. The artificial flame device of claim 7 wherein said flame structure comprises a height between said first light source and said flame structure closed end which is greater than a minimum transverse distance from said second light source to said flame structure exterior surface.

* * * * *